United States Patent [19]

Prager

[11] Patent Number: 4,941,222

[45] Date of Patent: Jul. 17, 1990

[54] PORTABLE LOUNGE

[76] Inventor: Howard A. Prager, 28 Mandon Dr., Wayne, N.J. 07470

[21] Appl. No.: 111,782

[22] Filed: Oct. 21, 1987

[51] Int. Cl.[5] ..... A47C 20/00

[52] U.S. Cl. ..... 5/111; 5/431; 5/446; 5/465

[58] Field of Search ..... 5/110, 111, 435, 446, 5/465, 436, 437, 431; 297/397, 410

[56] References Cited

U.S. PATENT DOCUMENTS

| | | | |
|---|---|---|---|
| 2,905,230 | 9/1959 | Gabriel | 297/410 |
| 3,698,023 | 10/1972 | Archbold | 5/436 X |
| 3,747,916 | 7/1973 | Benson | 5/435 X |
| 3,842,453 | 10/1974 | Redfield | 5/436 |
| 3,897,102 | 7/1975 | Lemaire | 5/111 X |
| 4,074,374 | 2/1978 | Ayesh | 5/436 X |
| 4,163,297 | 8/1979 | Neumark | 5/446 |
| 4,474,370 | 10/1984 | Oman | 5/446 X |
| 4,489,452 | 12/1984 | Lickert | 5/465 |
| 4,606,086 | 8/1986 | Rowland | 5/111 |

FOREIGN PATENT DOCUMENTS

| | | | |
|---|---|---|---|
| 1241643 | 8/1960 | France | 5/446 |

*Primary Examiner*—Alexander Grosz
*Assistant Examiner*—Michael F. Trettel
*Attorney, Agent, or Firm*—Richard T. Laughlin

[57] ABSTRACT

This invention relates to a portable lounge with body supports which are adjustable to conform with body frames of different girths and heights. It is ergonomically correct to alleviate stress on the lower back, head, neck and legs by reducing pressure while relaxing.

5 Claims, 2 Drawing Sheets

PORTABLE LOUNGE

BACKGROUND OF THE INVENTION

While the typical lounge and/or beach chair is designed for the user to lie only on their back, it fails to keep the body's normal biomechanics in mind. Proper support must be used in the lumbar and cervical spine to alleviate any uneven pull and fatigue of the spinal musculature. These problems occur when one attempts to lie on their stomach on a chair/lounge of any type currently in existence.

Many individuals have difficulty in sleeping or resting comfortably in a face down or face up position. A number of devices have been suggested to overcome this problem. One of the major difficulties is that the proportions or size of users of such equipment vary widely and as a result the design of a suitable resting surface is made to accommodate the average frame which makes it unsuitable for most users.

A large number of tables and portable lounges have been devised which give various types of support to the body. Typical of such designs is a sun tanning lounge disclosed in U.S. Pat. No. 4,207,635 issued June 17, 1980 to Michel Leroy which is designed for the vertical and/or dorsal decubitus. In accordance with such patent vertical or dorsal support is given by providing a converse surface on which the abdomen can rest when the user is in a face down elongated or prone position and a converse surface by reversing the structure when the user is facing upward. In certain configurations the lounge can be placed on an incline and a cutout made where the users face and protrude when on his abdomen. A similar chiropractic table is shown in U.S. Pat. No. 3,747,916 issued July 24, 1973 to John S. Benson.

U.S. Pat. No. 1,194,112 issued Aug. 8, 1916 to W. S. & D. E. Wood discloses a collapsible, manipulating table by doctors or chiropractors. This table is provided with a flexible section for anterior curvature of the abdominal portion of the human body when lying in a prone position. In U.S. Pat. No. 3,828,377 issued Aug. 13, 1974 to George D. Fary an adjustable body rest is disclosed which intended to support the human body when lying in a face down position. A head or face rest is provided having an open portion for the nose and mouth in combination with a chest or shoulder support which is adjustable to different body dimensions. A some what similar construction is shown in U.S. Pat. No. 3,808,615 issued on May 7, 1974 to William M. Geary.

A bag lounge is disclosed in U.S. Pat. No. 2,910,707 issued Nov. 3, 1959 to M. L. Lawser and Florence J. Schippert. The bag contains two hollow elements which are curved transversely as to permit their use as a headrest and a knee support. The user separates the two supports a distance to conform with his or her comfort level and lays them on the ground. A mattress pad is disclosed in U.S. Pat. No. 1,045,228 issued Nov. 26, 1912 to T. C. Weltmer which is provided with a stuffed section which fits under the curvature of a person sleeping on his or her side.

OBJECTS OF THE INVENTION

An object of the invention is to provide a lounge allowing support in both the ventral and dorsal positions.

Another object of the invention is to provide such a lounge which is portable.

A further object of the invention is to provide such a lounge which is readily adjustable to provide proper support for users of different sizes and shapes.

Other objects and the advantages of the invention will appear from the following detailed description.

SUMMARY OF THE INVENTION

In accordance with the invention, a unique lounge is presented that solves all of the comfort and biomechanical problems of previous furniture types. This lounge gives proper cervical, lumbar and leg support when lying on one's back. Additionally, it solves the many structural problems of lying on the stomach by using a prone-face opening, an abdominal/lumbar support, and an ankle support to diminish low back pressure. The lounge has the ability to completely flatten so as to afford the user the ability to lie on their stomach. The slideable foam supports are able to accomodate variable body frames and types.

The lounge is provided with upholstered supports for giving cervical support to the neck and for the legs which can be adjusted in the plane of the body for use with bodies of various height and dimensions. It also can provide support for the abdomen and ankles when utilized in the face down position. Further the lounge of the invention can be provided with an opening for the face to allow ease of use when laying on the stomach in the prone position. If desired the sides of the lounge can be provided with arm rests for supporting the arms while in use. As is seen the lounge of the invention is a simple method of giving full and comfortable support to the user of the portable lounge.

THE DRAWINGS

DETAILED DESCRIPTION OF ONE EMBODIMENT OF THE INVENTION

Figure 1:
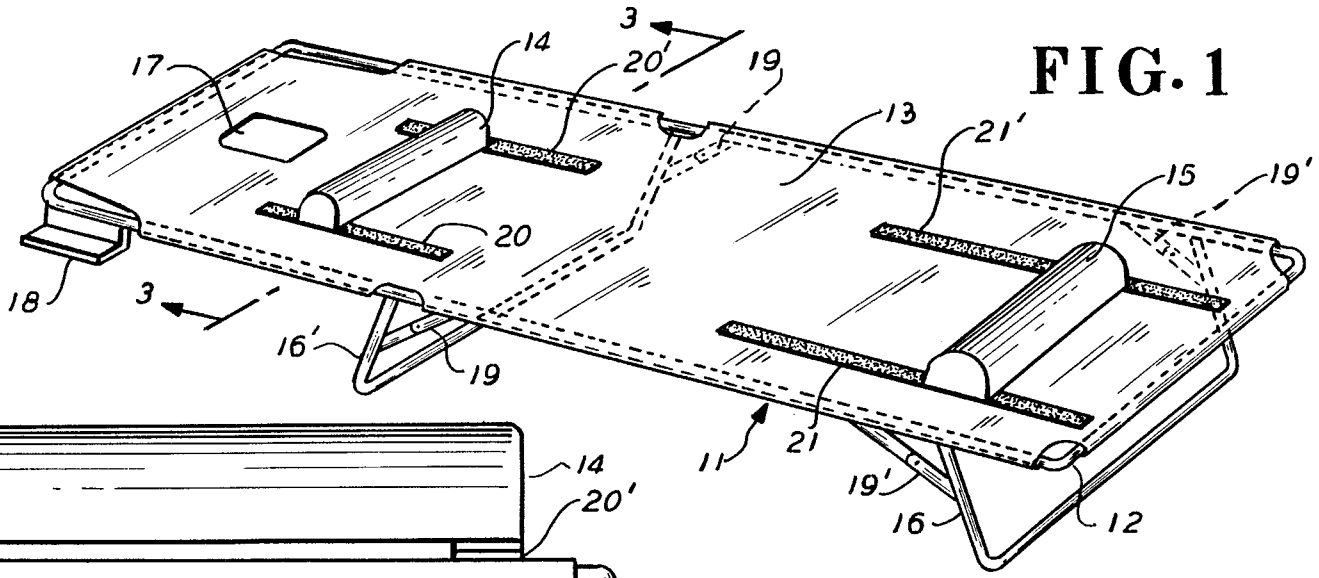
FIG. 1 represents a view in perspective of a first embodiment of the lounge of the invention.
Figure 2:
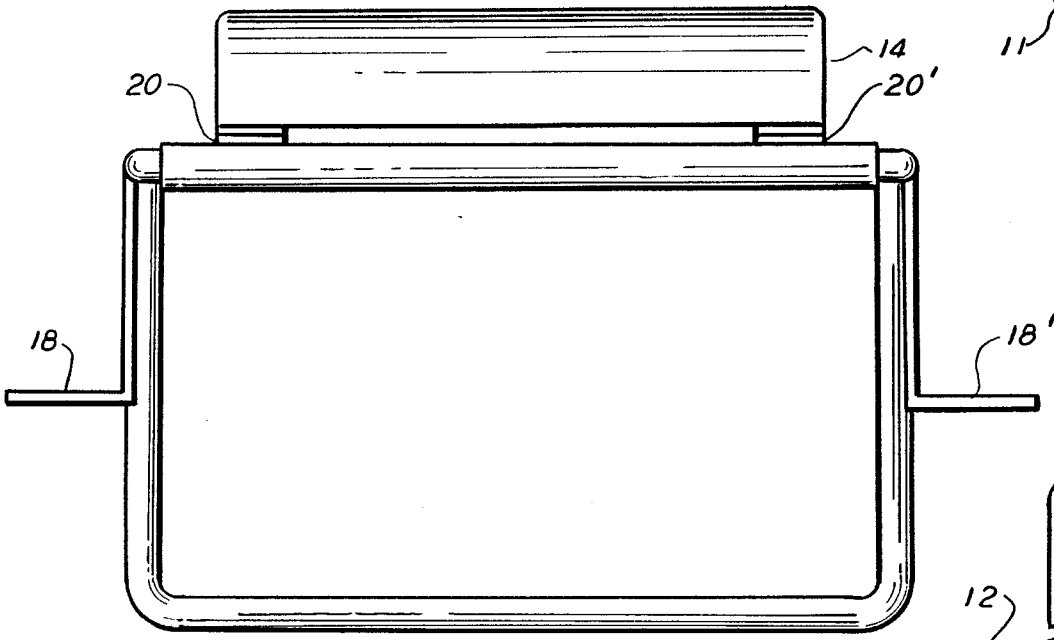
FIG. 2 is an end elevation of the lounge shown in FIG. 1.

Referring to the drawings, FIGS. 1 and 2 show one embodiment of the invention in which a light weight frame is provided generally indicated at 11. The frame is preferably made of tubular aluminum stock 12 with telescoping or folding sections for ease of portability. As an illustration the frame may be connected at any suitable point with hinges of a conventional type to allow the sections to be folded together to permit ease of carrying.

The frame can be covered with any suitable material to form the resting surface 13 of the lounge. Typical of suitable materials are canvas, plastic bands and woven fiber glass. The cover can be provided with sleeves around its perimeter into which the frame can be slipped or inserted. As a general rule the cover should be stretched between the frames to be taut to provide good support so that there is a minimum of slack of the material to insure the maximum body support. As an alternative the resting surface can be molded of plastic in one or more sections.

Figure 4:
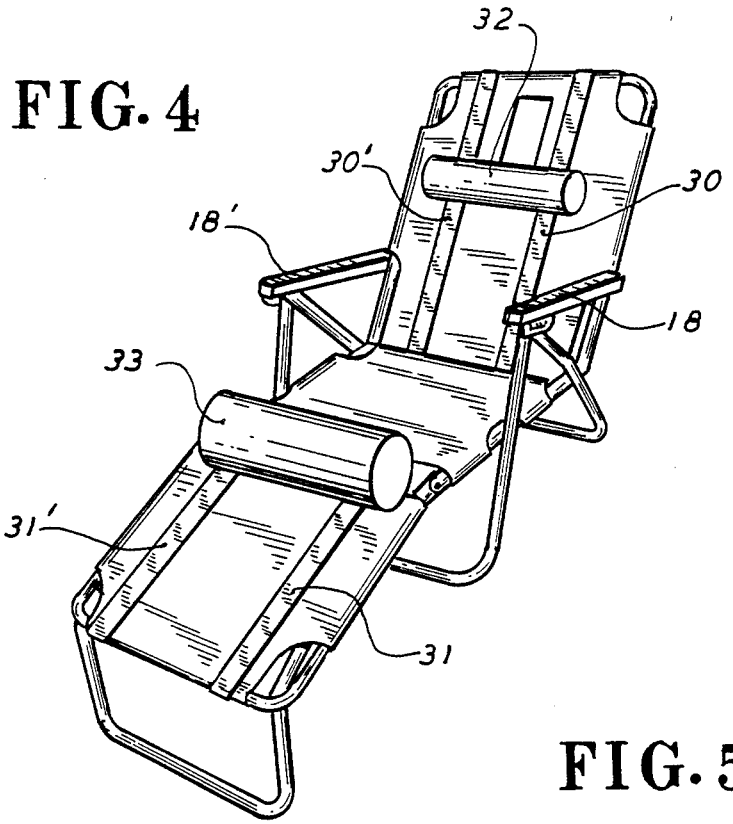
FIG. 4 is a perspective view of the lounge of the invention in a chair configuration.
Figure 5:
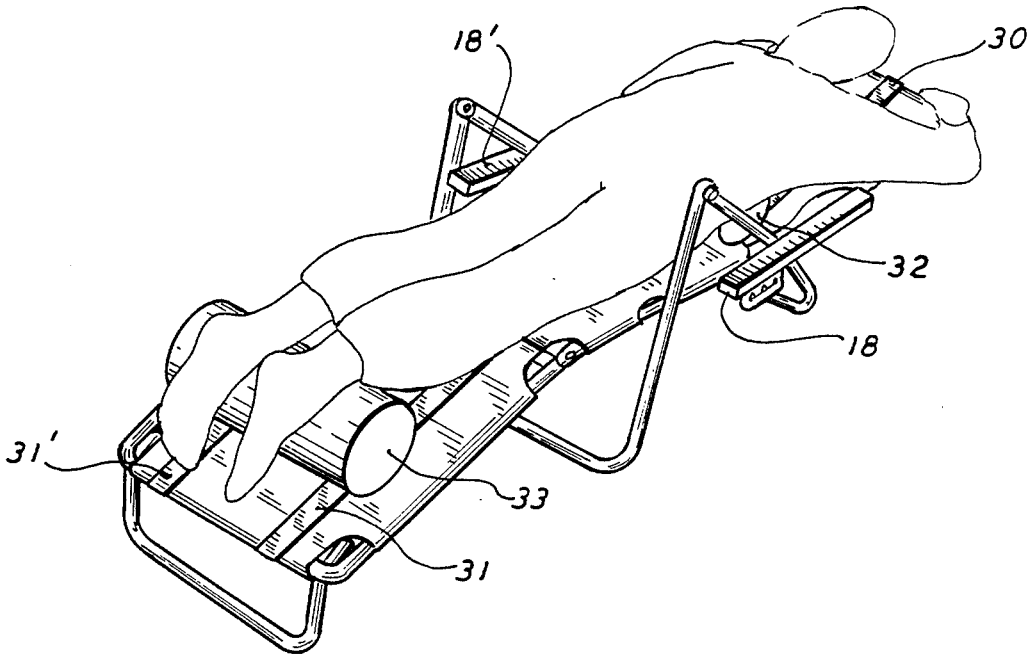
FIG. 5 is a perspective view of the lounge of the invention showing the outline of the user in a face down or prone position.

The lounge of the invention gives a comfortable decubitus both in the ventral and dorsal position and is so ergonomically correct that it can help to alleviate stress on the lower back, head, neck and legs by reducing pressure while relaxing. The lounge is preferably about twenty one inches in width. In order to accomplish the desired result it is provided with a supine cervical upper support 14 which is slideable in the plane of the lounge to become an abdominal/lumbar support when the user is in a prone or face down position. The support 14 is preferably slideable for about eighteen inches extending from about twelve inches from the top or head of the lounge. This support is preferably convex in shape, with a maximum of four inches in height but it can be cylindrical. The support can extend across the width of the lounge and preferably four inches in length, approximately sixteen inches in width and about four inches at its maximum convex height curving to a relatively thin layer at each side. This support is preferably made of an upholstered material such as polyurethane cushion which is firm but comfortable to lie on. A second, lower support 15 is provided for the supine popliteal area or when used in the prone position ankle support which is also slideable in the plane of the lounge for preferably approximately twenty two inches and extends from the end or foot of the lounge. This support prevents strain on the lower back. This second support also has a convex shape extending across the lounge and preferably about eight inches in width, approximately sixteen inches in length across the lounge, and about four inches at its maximum convex height. It is constructed in a manner similar to the supine cervical support. FIGS. 4 and 5 show the position of the support when used in a chair or in the prone position.

Figure 3:
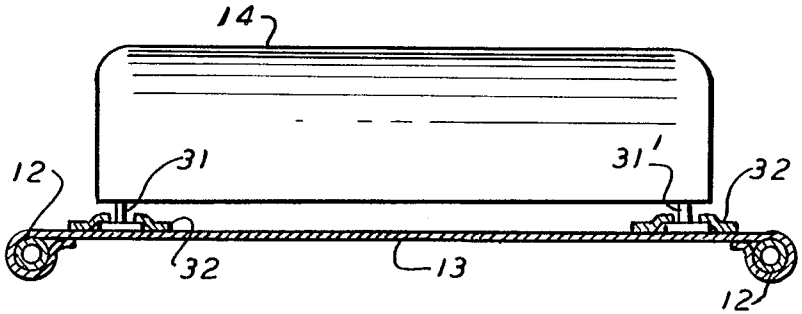
FIG. 3 is a cross sectional view taken along line 3—3 of FIG. 1 showing a second method for affixing the body supports to the upper surface of the lounge.

As indicated a particular feature of the invention is that the two supports are adjustable so that they fit the particular frame and weight of the user. This is accomplished in one of the preferred embodiments by utilizing parallel strips of a hook and pile type fastener, which is sold under the trademark VELCRO, 20, 20' and 21, 21' affixed to the top surface of the lounge. The strips can be any width but a one inch width has been found suitable. Similar strips are secured to the bottom of each support. In a preferred arrangement the strips will extend for eighteen inches for the upper support and twenty two inches for the lower support. In this manner the supports can be securely affixed to the surface of the lounge when in use but can readily be adjusted by removing the support and refastening in the selected position. An alternate method of securing the supports to the surface of the lounge is shown in FIG. 3. In this arrangement the support indicated at 14 in FIG. 3 has "T" shaped flanges 31, 31' which are affixed to the bottom of each support with the upper bar of the T being in the lower position. The "T" shaped member can be made of any stiff material such as reinforced fabric or even metal such as aluminum. The upper bar of the T of the flanges rides in tracks or channel 32, 32' which have an opening big enough to accomodate the thickness of the stem of the T, but small enough to hold the upper bar of the T in the channel. The tracks can be formed of fabric sewn or otherwise attached to the surface of the lounge forming the channel in which the upper bar of the T rides or slides. The supports can also have axles which are affixed to the sides of the frame and slide in channels in the frame. Another method of affixing the supports to the lounge is by use of parallel bands 30, 30', 31, 31' of cloth or plastic to which the supports 32, 33 are secured. In this manner, by moving the bands the location of the supports can be adjusted. This configuration is shown in FIGS. 4 and 5.

In one modification of the invention the legs 16, 16' of the lounge are sufficiently long to allow ease of getting on and off the lounge. The legs can be U-shaped and may be associated with the frame to enable the support to be placed in an inclined position by using only one of the legs 16 the other leg lying flat on the supporting surface.

The lounge of the invention can be provided with an opening or break 17 on the end opposite the head. This opening is preferably located at the middle of the lounge, about four inches from the top or head of the lounge. The opening can be about two inches in width and eight inches in length. This arrangement enables the head to rest essentially on the forehead, and possibly on the chin, and even on the cheek parts. This particularly allows the user to lie on the rest surface according to the invention, for an extended period of time, under very comfortable conditions, while resting a book or the like plumb with the opening 17. By this novel construction and arrangement of the invention the mouth and nose are unobstructed thereby assuring free breathing and more relaxed resting.

A canopy can be positioned over the lounge to shield the user from the sun or other light. The canopy can be fastened by the use of any suitable fasteners such as a ball joint to allow the canopy to be moved to the desired position, by means of the ball and socket joints having a pressure fit.

In another modification of the invention the lounge can be provided with an adjustable arm rest 18, 18' which finds particular use when the user is in the prone position. Further conventional arms rests can be used when the lounge is configured in the form of a chair.

The adjustability of the lounge of the invention allows each of the elements to be positioned at a suitable angle with respect to the other, whilst assuring the stability of the whole. Under these conditions it will be possible for user to regulate the angular positioning of the elements as he wishes, and to obtain a position which is extremely comfortable, both from the point of view of his individual morphology and from that of that particular circumstance.

It is to be understood that when referring to relatively or substantially stiff elements, the same may be actually rigid if desired, but likewise if preferred they may be slightly yielding so as to thereby yield to the weight of the user. Each support can be provided with removable protective covers.

In the operation of my invention, when the user desires to lie in a different position he or she can adjust the supports to the particular configuration selected.

While this invention has been described with particular reference to its use in a face down or face up position, it is obvious that it can be employed in other configurations and other modifications can be made without departing from the spirit and scope of the invention.

What is claimed is:

1. In a portable lounge having a body support portion with an upper surface for supporting a body of a user, and having a frame with generally parallel sides joined to a head portion and lower portion, said sides having portions being adjustable relative to each other and said sides being provided with legs to maintain the stability of the lounge in various configurations, the improvement which comprises incorporating in the body support portion a first cylindrical supine cervical or neck support and a second cylindrical prone abdominal/lumbar support, each said first and second support being disposed at a right angle to the parallel sides, adjusting means for each support comprising two parallel channel-shaped tracks formed by strips of fabric affixed to an upper side of the upper support portion surface with each track receiving a T-shaped runner flange affixed to a bottom end of each support with the upper bar of the T being in the channel for allowing these two supports to be moved in a horizontal direction along the surface of the lounge by an exertion of a substantial force on the runners and to retain the position selected without movement and an aperture means near an upper end of the body support portion which is adapted to receive the face of the user and permits a frontal support of the head of the user.

2. The lounge of claim 1 wherein the body support portion and frame includes a base, a rest surface provided at one end of said base, and at least one means of connection between the base and the rest surface, which is adapted to permit a regulation of an inclination of the rest surface with respect to the base.

3. The lounge of claim 1 wherein cantilevered arm rests are provided on each side of the head portion of the lounge for supporting the arms of the user when the arms are extended above the head of the user.

4. The lounge of claim 1 wherein the channel has an opening big enough to accomodate the thickness of the stem of the T, but small enough to hold the upper bar of the T in the channel.

5. The lounge of claim 4 wherein the lounge is provided with horizontal arm rests for utilization when the lounge is in a chair configuration, and wherein the T-shaped flanges are made of a stiff material.

* * * * *